US007090618B2

(12) United States Patent
Stout et al.

(10) Patent No.: US 7,090,618 B2
(45) Date of Patent: Aug. 15, 2006

(54) AQUATIC EXERCISE DEVICE

(75) Inventors: Tadlington A. Stout, La Jolla, CA (US); James P. Cleary, San Diego, CA (US)

(73) Assignee: Aqualogix, Inc., San Diego, CA (US)

( * ) Notice: Subject to any disclaimer, the term of this patent is extended or adjusted under 35 U.S.C. 154(b) by 0 days.

(21) Appl. No.: 10/729,296

(22) Filed: Dec. 5, 2003

(65) Prior Publication Data

US 2004/0116256 A1 Jun. 17, 2004

Related U.S. Application Data

(60) Provisional application No. 60/341,380, filed on Dec. 6, 2002.

(51) Int. Cl.
*A63B 31/00* (2006.01)
*A63B 31/10* (2006.01)

(52) U.S. Cl. ..... 482/55; 21/678

(58) Field of Classification Search ..... 482/55, 482/56, 108, 111, 148, 44, 49; D21/678, D21/789; 441/56, 58, 136
See application file for complete search history.

(56) References Cited

U.S. PATENT DOCUMENTS

| | | | | | |
|---|---|---|---|---|---|
| 3,809,397 | A | * | 5/1974 | Gruenewald | 473/457 |
| 4,468,023 | A | * | 8/1984 | Solloway | 482/10 |
| 4,623,142 | A | * | 11/1986 | MacKechnie | 482/111 |
| 4,819,951 | A | * | 4/1989 | Solloway | 482/111 |
| D344,113 | S | * | 2/1994 | Shelton et al. | D21/678 |
| 5,478,312 | A | * | 12/1995 | Weissbuch | 482/111 |
| 5,531,657 | A | * | 7/1996 | Macedo | 482/111 |
| 5,766,116 | A | * | 6/1998 | Weissbuch | 482/111 |

* cited by examiner

*Primary Examiner*—Jerome Donnelly
*Assistant Examiner*—Tam Nguyen
(74) *Attorney, Agent, or Firm*—Gavrilovich, Dodd, and Lindsey, LLP

(57) ABSTRACT

An aquatic exercise device includes a handle connected to a dome-shaped bell where an angle between the handle axis and the bell axis is not ninety degrees. The bell axis extends from an apex opposite an opening of the dome-shaped bell through a center of the opening. The aquatic exercise device is configured to provide an omni-directional and omni-rotational resistance to movement in water and may include a plurality of fins arranged on an outer surface of the dome-shaped bell.

14 Claims, 6 Drawing Sheets

AQUATIC EXERCISE DEVICE

CROSS REFERENCE TO RELATED APPLICATIONS

This application claims the benefit of priority of U.S. Provisional application Ser. No. 60/431,380 filed on Dec. 6, 2002, entitled "Aquatic Fitness Device" and which is incorporated by reference in its entirety herein.

BACKGROUND

The following description relates in general to physical exercise and physical therapy, and more specifically to an apparatus and method for exercise and physical therapy in water.

Aquatic physical exercise has been found to be one of the best forms of exercise. Water supports an individual's body and alleviates most of the effects of gravity allowing the individual to exercise prescribed specific muscle groups without stressing other areas of the body. The reduced physical strain on these other area allows the individual to exercise for longer periods of time. The individual is also able to exercise longer due to a lower and more stabilized body temperature resulting from contact with the water. Strain on the heart, muscles and ligaments is minimized while the benefits of physical activity are maximized.

Accordingly, aquatics-based physical therapy is most noticeably gaining popular with the elderly, the obese, and the infirm. There is a huge demand for an exercise modality which provides long-term health benefits and which can exist in the favorable environment of lower stress and freer movement. Conventional aquatic exercise devices and methods, however, are limited in several ways. For example, conventional devices do not offer uniform resistance when moved through the water. As a result, the devices feel awkward and unstable to the user. In addition, conventional aquatic devices include a single handle connected in an orientation that prohibits certain exercise motions. Further, conventional aquatic exercise devices do not provide the appropriate resistance training for enhancing performance in sporting activities. Conventional aquatic exercise devices, for example, do not target muscle groups for specific sports or activities such as golf, baseball, kayaking, or other activities that utilize a hand-held device such as, for example, a racket, bat, paddle, or club.

Therefore, there exists a need for an aquatic exercise device and method that provide uniform resistance for an increased range and variety of motions.

DETAILED DESCRIPTION

The exemplary aquatic exercise device includes at least one dome-shaped bell having an opening and a plurality of apertures adapted to allow water flow when the device is moved through water. A handle connected to the dome-shaped bell is positioned outside of an interior of the dome-shaped bell. In some circumstances, the dome-shaped bell has a plurality of fins symmetrically arranged along an outer surface of the dome-shaped bell. When moved through the water, the aquatic exercise device provides a resistance for stimulating muscle activity useful for physical training for a particular sporting activity as well as general fitness training. The non-perpendicular handle allows the user to realize an increased range and variety of motion: Training for a particular sporting activity is targeted by engaging in exercises using an aquatic exercise device with selected characteristics. The orientation and position of the user's hands relative to the dome-shaped bell, in addition to other device characteristics, determine the resistance and motion most suitable for a targeted sporting activity.

Figure 1:
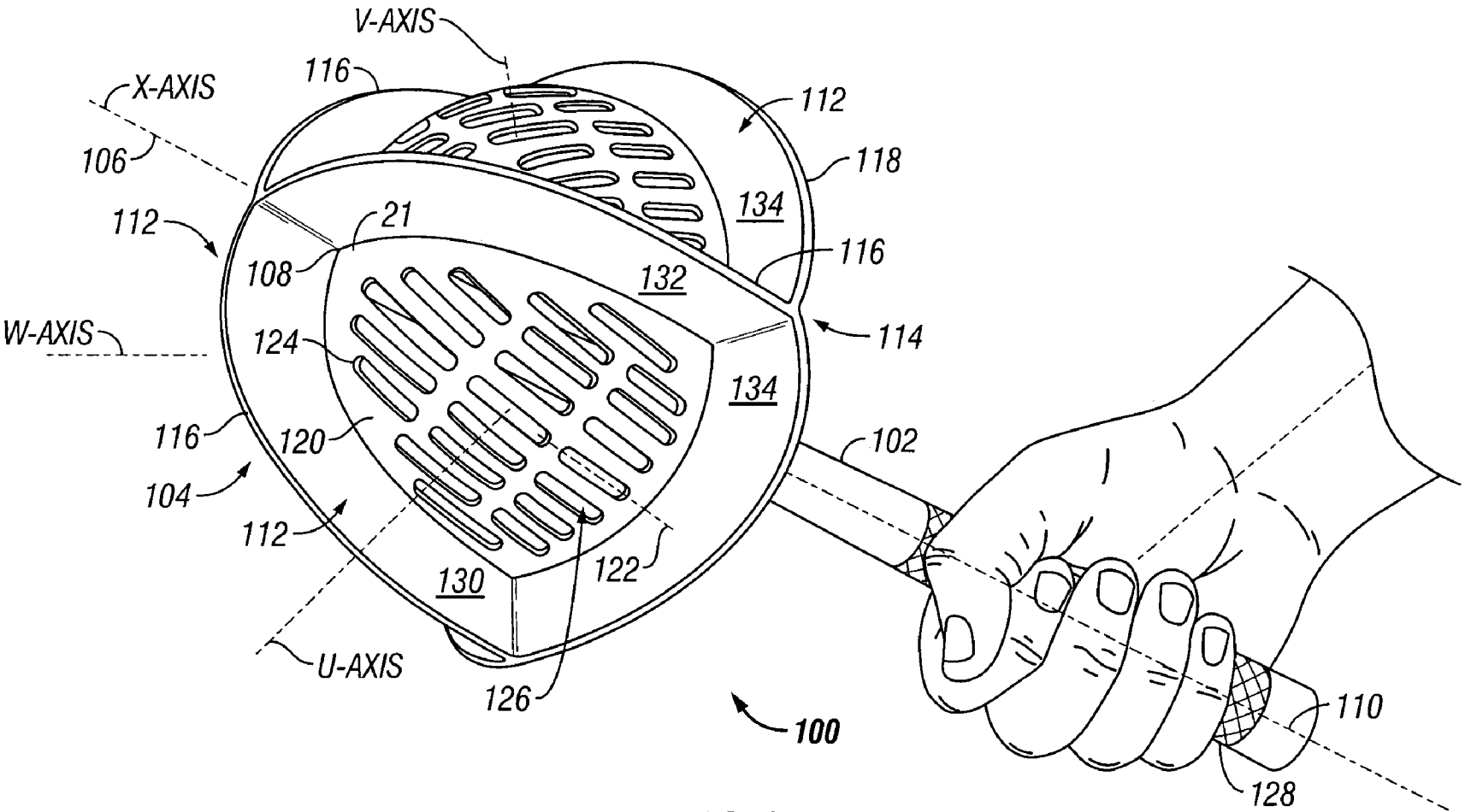
FIG. 1 is an illustration of a perspective view of an aquatic exercise device in accordance with a first exemplary embodiment of the invention.

FIG. 1 is an illustration of a perspective view of an aquatic exercise device 100 in accordance with a first exemplary embodiment of the invention. The aquatic exercise device 100 includes at least one handle 102 connected to a dome-shaped bell 104. The dome-shaped bell 104 has a bell axis 106 extending from an apex 108 of the dome-shaped bell 104 to the center of the bell opening 114. The handle 102 is connected to the dome-shaped bell 104 such that a handle axis 110 is non-perpendicular to the bell axis 106. In the first exemplary embodiment, the handle axis 110 coincides with the bell axis 108 and, therefore, the handle angle between the handle axis 110 and the bell axis 106 is zero degrees. In some circumstances, however, a non-zero angle is formed between the handle axis 110 and bell axis 106.

The dome-shaped bell 104 may be formed using a variety of techniques and materials. An example of a suitable construction is discussed in U.S. patent application Ser. No. 10/044,552, entitled "Aquatic Exercise Device" which is incorporated by reference herein. Generally, in the first exemplary embodiment, the dome-shaped bell 104 has a symmetrical polyhedron shape similar to a bell and is configured to minimize differences in resistance due to changes in the direction of motion through water. Two or more curved sections 112 are secured to each other to form an at least partial ovoid that gradually expands from the apex 108 to its widest point at the bell opening 114. The dome-shaped bell 104, therefore, formed from the plurality of sections 112 is an ovoid where the base of the ovoid coincides with the bell opening 114. In the exemplary embodiment, the dome-shaped bell 104 is formed from three identical curved sections 112 that are secured to each other using an adhesive or bonding agent. The dimensions and shape of the sections 112 depend on the number of sections 112 used to form the dome-shaped bell 104. As the number of sections 112 increases, the width of each section 112 decreases. Alternatively, the dome-shaped bell 104 is formed from a single ovoid piece that provides any number of sections 112.

A three dimensional coordinate system having an X-axis perpendicular to a U-axis, a V-axis, and a W-axis is shown in FIG. 1. The X-axis extends from the apex 108 and along the center of the dome-shaped bell 104 and, therefore, coincides with the bell axis 106. The U-axis, V-axis, and W-axis each extend from the X-axis through a midpoint between the axial fins of each section 112. The angles between the U-axis, V-axis, and W-axis, therefore, depend on the number of sections 112 used to form the particular dome-shaped bell 104.

In the first exemplary embodiment, each section 112 includes an outer surface 120 outlined by two axial fins 116 and a transverse fin 118 where each axial fin 116 of each section 112 is secured to an axial fin 116 of another section to form a single axial fin 116. In some circumstances, the fins 116, 118 may be omitted and the sections 112 are secured to each other at the axial edges of the sections 112. In the exemplary embodiment, the axial fins 116 and the transverse fins 118 extend perpendicular to a tangent line on the spherical surface 120 and the transverse fins 118 extend at an angle greater than ninety degrees from the X-axis. The transverse fins 118, therefore, extend slightly toward the handle 102 in the first exemplary embodiment. The fins 116, 118, however, may be of any size and shape and may extend at any angle from the tangent line on the spherical surface 120. The axial fins are parallel to the bell axis 106 (and X-axis) and the transverse fin 118 is transverse to the X-axis 106.

The spherical surface 120 of each section includes a plurality of apertures 124 configured to allow water flow and stabilize movement of the aquatic exercise device 100 as it is moved through the water. The apertures 124 may have any of several shapes, sizes and arrangements. In one suitable arrangement, the apertures 124 are elongated along a central axis 122 through each of the apertures 124. The central axis 122 of each aperture 124 points toward the bell apex 108. The apertures 124 provide additional stability to the aquatic exercise device 100 during use by venting water through the apertures 124 in a direction that minimizes twisting when the device 100 is moved by the user in a back and forth motion through the water along the X-axis. In some situations, the fins 116,118 may also be formed with apertures to provide a calculated flow and to maximize stability. When the aquatic exercise device is moved backwards through the water (in a direction from the apex 108 toward the bell opening 114), the angled transverse fins 118 form a funnel that channels water into the inner chamber 126. The resistance created when the aquatic exercise device 100 is pushed and pulled along the X-axis through the water can be adjusted by changing the size of the apertures 124. Accordingly, the aquatic exercise device 100 may include different-sized or adjustable-sized apertures 124 that allow a user to adjust the resistance to a desired leveling in some circumstances.

During use, the user grasps the handle 102 at a handgrip 128. The handgrip 128 may be in the shape of a pistol grip or a straight rod that is located inside or outside of the inner chamber 126. In the first exemplary embodiment, the handgrip is outside the inner chamber 126 of the dome-shaped bell 104. The handgrip 128 is constructed of any material that provides additional friction between the user's hand and the handle 102 allowing the user to grip the handle 102. The handgrip 128 may be a softened or pliable layer attached to the handle 102, for example, such as rubber or neoprene. In some circumstances the handgrip 128 or handle 102 may include an attachment mechanism such as, for example, a glove or hook-and-loop attachment often referred to as "Velcro" for allowing a user with a weak or non-existent grip to utilize the aquatic exercise device 100. In some circumstances, the attachment mechanism includes a glove sized for a user for gripping a particular-sized handgrip 128, in which the glove may include one or more abutment elements for attaching to the handgrip 128.

When the aquatic exercise device 100 is laterally moved through the water, the angle of the fins 116, 118, and the pressure on the three fin surfaces 130, 132, 134 direct the force along the U-axis, V-axis, and W-axis axis. When the aquatic exercise device 100 is thrust forward, parallel to the bell axis 106 or X-axis, the sections 112 work in combination to produce a balanced force of resistance along the X-axis with minimal twisting force. In the exemplary embodiment, the changes in force magnitude due to changes in the direction of motion are minimized since the dome-shaped bell 104 is symmetrical around the X-axis (bell axis) 106. The resistive force on the dome-shaped bell 104 is translated to the user through the handle 102. The magnitude and direction of the force experienced by the user depends on the length and shape of the handle 102, the handle angle between the handle axis 110 and the bell axis 106, the size and shape of the dome-shaped bell 104, the size and shape of the fins 116,118 and the magnitude and direction of the motion of the dome-shaped bell 104 as well as other factors. The user moves the aquatic exercise device 100 through the water in a variety of directions across the body. The motions can be adjusted to mimic motions used during particular sporting activities. Where the handle 102 is relatively short and straight and has a handle axis 110 coinciding with the bell axis 106 (zero degree handle angle), the user can experience resistances similar to those when swinging a racquet. As discussed below, a longer handle 102 can be used for simulating a baseball bat swinging motion. A longer handle connected at the appropriate handle angle provides a resistance similar to the resistance experienced during the swinging of a golf club or hockey stick. The magnitude of the forces resulting from using the aquatic exercise devices 100 are greater than those experienced during the sporting activities allowing for controlled and efficient muscle development. Accordingly, as the devices are moved through the water, the additional resistance decreases the speed of the motion allowing the user to concentrate on the form of the motion while achieving focused training of selected muscle groups.

Figure 2:
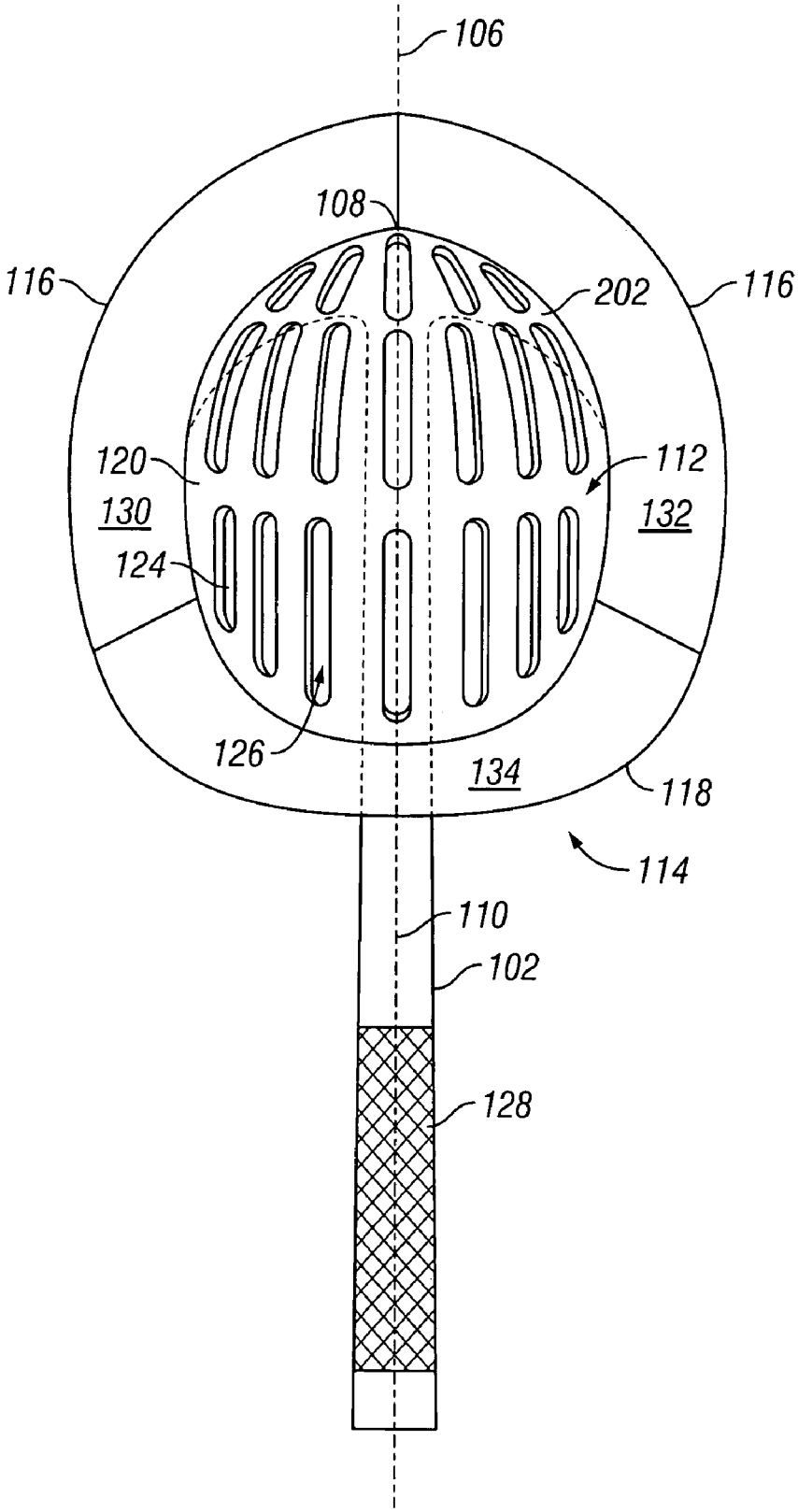
FIG. 2 is an illustration of a side view of the aquatic exercise device in accordance with the first exemplary embodiment.

FIG. 2 is an illustration of a side view of the aquatic exercise device 100 in accordance with the first exemplary embodiment. Any of several techniques and mechanisms can be used to attach the handle 102 to the interior of the dome-shaped bell 104. In the first exemplary embodiment, the handle 102 includes a plurality of ribs 202 that coincide with the intersections between the sections 112. Each rib 202 of the handle 102 is bonded to the dome-shaped bell 104 at the intersection between two sections 112. Examples of other suitable techniques for connecting the handle 102 to the dome-shaped bell 104 include using screws or other fasteners, using a force fit interconnection, molding the handle 102 with the one or more of the sections 112, and using a releasable mechanism.

Figure 3:
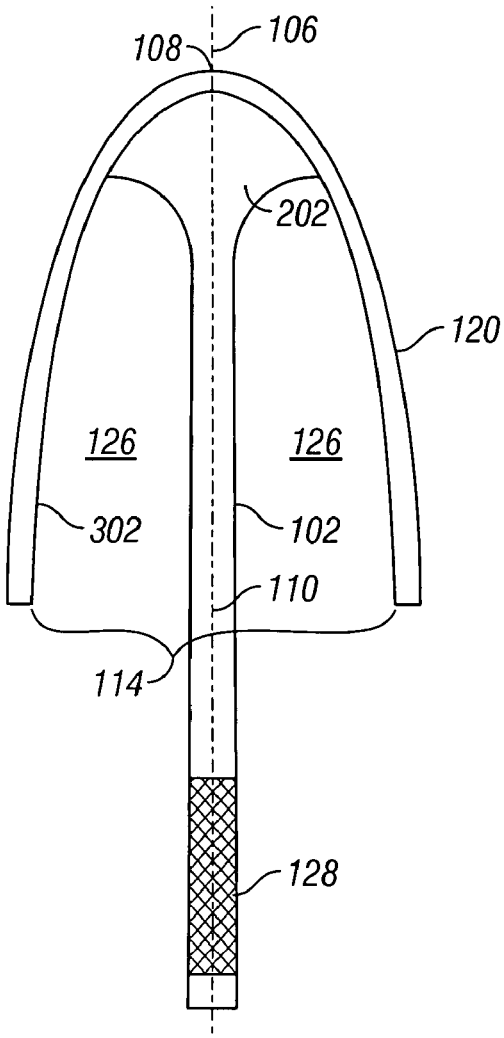
FIG. 3 is an illustration of a sectional view side view of the aquatic exercise device in accordance with the first exemplary embodiment of the invention.

FIG. 3 is an illustration of a sectional view side view of the aquatic exercise device 100 in accordance with the first exemplary embodiment of the invention. In the interest of clarity, the fins 116, 118 and the apertures 124 are not shown in FIG. 3. The plurality of ribs 202 are bonded to the interior surface 302 of the dome-shaped bell 104 using an adhesive in the first exemplary embodiment. As explained above, the ribs 202 and handle 102 may be attached to the dome-shaped bell 104 using other techniques. In the first exemplary embodiment, at least a portion of the handle 102 and the handgrip 128 are located outside of the inner chamber 126 of the dome-shaped bell 104.

Figure 4:
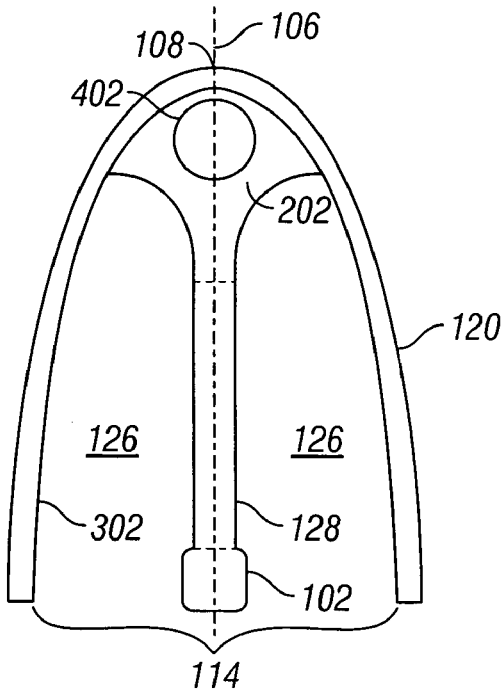
FIG. 4 is an illustration of a sectional side view of an aquatic exercise device in accordance with a second exemplary embodiment of the invention where the handle and the handgrip are located within the inner chamber (interior) of the dome-shaped bell.

FIG. 4 is an illustration of a sectional side view of an aquatic exercise device 200 in accordance with a second exemplary embodiment of the invention where the 102 handle and the handgrip 128 are located within the inner chamber 126 (interior) of the dome-shaped bell 104. In the interest of clarity, the fins 116, 118 and the apertures 124 are not shown in FIG. 4. In the second exemplary embodiment, the handle 102 includes a weight 402. The weight 402 can be any material that adds mass to the aquatic exercise device 200 and provides a counter weight for added stability. A suitable method of implementing the weight 402 includes press fitting a metal pin into a bore within the rib 202 or handle 102. The weight may be implemented and attached in any of a variety of ways. The weight 402, for example, may be releasably attached to allow the user to select a desired weight 402 from an assortment of weights 402 in some circumstances. Any of the exemplary embodiments discussed herein may be implemented to include a weight 402.

Figure 5:
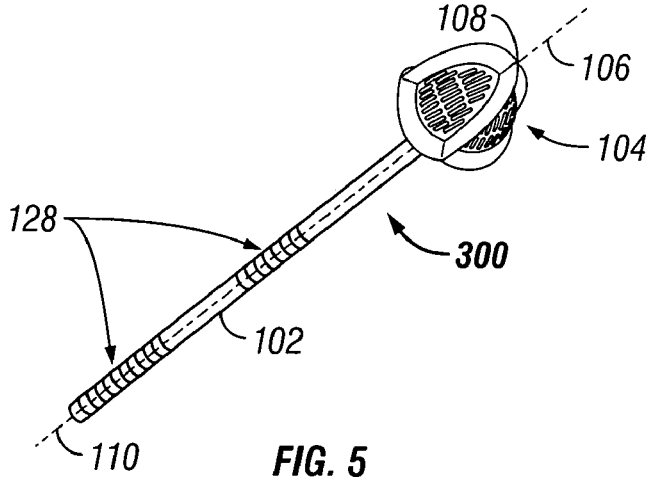
FIG. 5 is an illustration of a perspective view of an aquatic exercise device in accordance with a third exemplary embodiment of the invention.

FIG. 5 is an illustration of a perspective view of an aquatic exercise device 300 in accordance with a third exemplary embodiment of the invention. The aquatic exercise device 300 includes a dome-shaped bell 104 and a handle 102 where the handle 102 can be grasped by two hands and includes two handgrips 128. In the third exemplary embodiment, the handle 102 has a length consistent with a sport apparatus such as a baseball bat, or a "crosse" racquet used in lacrosse. The dome-shaped bell 104 may include any of several types of fins 116, 118. Further, one or more of the fins 116, 118 may be omitted in some circumstances. A suitable exercise using the aquatic exercise device 300 include grasping the two handgrips 128 and moving the dome-shaped bell 104 through the water in a swinging motion or rowing motion. In some circumstances, the user's shoulders are stationary while the arms are used to move the aquatic exercise device 300. In other situations, the dome-shaped bell 104 is maintained a selected distance from the user as the user rotates the upper body to target abdominal muscle groups. Other motions will be readily recognized by those skilled in the art based on these teachings.

Figure 6:
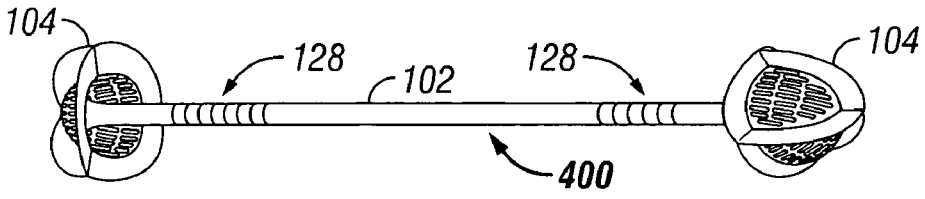
FIG. 6 is an illustration of a perspective view of an aquatic exercise device in accordance with a fourth exemplary embodiment of the invention.

FIG. 6 is an illustration of a perspective view of an aquatic exercise device 400 in accordance with a fourth exemplary embodiment of the invention. A handle 102 is attached to two dome-shaped bells 104 in the fourth exemplary embodiment. The handle 102 may include any number of handgrips 128. In some circumstances the handgrips 128 may be configured to rotate relative to the handle 102. In the fourth exemplary embodiment, the height of the fins 116, 118 is minimized. The fins 116, 118 may be of any size or shape or may be may be omitted in some situations. Examples of suitable exercises using the aquatic exercise device 400 include simulated rowing motions, pugilist motions, bicep curls, and triceps extensions. Another exercise includes holding the aquatic exercise device 400 with both hands at a constant distance from the torso while performing a rotating motion by twisting the trunk. In some circumstances, the handle 102 may include curves or may be bent to accommodate a desired grip.

Figure 7:
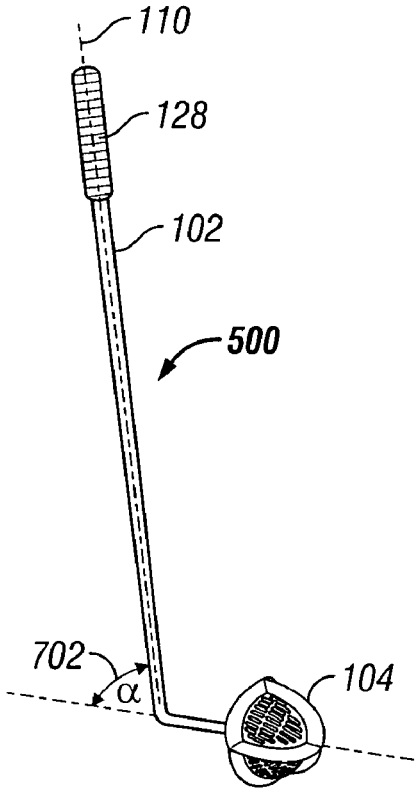
FIG. 7 is an illustration of a perspective view of an aquatic exercise device in accordance with a fifth exemplary embodiment of the invention.

FIG. 7 is an illustration of a perspective view of an aquatic exercise device 500 in accordance with a fifth exemplary embodiment of the invention. In the fifth exemplary embodiment, the handle angle 702 between the handle axis 110 and the bell axis 106 is an angle between zero and 90 degrees. The aquatic exercise device 500 is configured to simulate a motion of golf club when moved through the water. In some situations, the aquatic exercise device 500 may be configured to simulate the motion of a hockey stick when in use. As explained above, although the general motion is similar that experienced with an actual golf club or hockey stick, the speed and resistance experienced when using the aquatic exercise device 500 are different allowing the user to focus on muscle development and coordination at a slower training speed.

Figure 8:
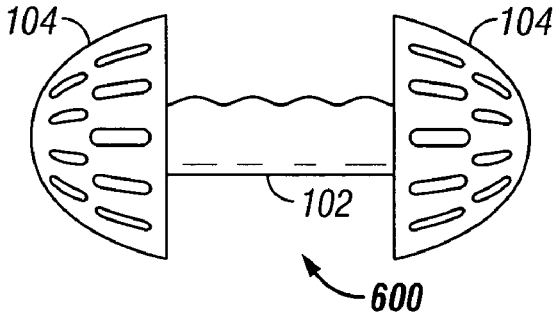
FIG. 8 is an illustration of a perspective view of an aquatic exercise device in accordance with a sixth exemplary embodiment of the invention.

FIG. 8 is an illustration of a perspective view of an aquatic exercise device 600 in accordance with a sixth exemplary embodiment of the invention. The aquatic exercise device 600 includes a handle 102 connected between dome-shaped bells 104 where the handle 102 has length sufficiently short to allow the aquatic exercise device 600 to be used as an aquatic dumbbell. The handle may be shaped as a "pistol" grip in some circumstances to further facilitate the user's ability to grasp the handle 102. Although the dome-shaped bells 104 do not include any fins 116, 118 in the fourth exemplary embodiment, the any number of axial fins 116 and transverse fins 118 having any size or shape may be used.

Figure 9:
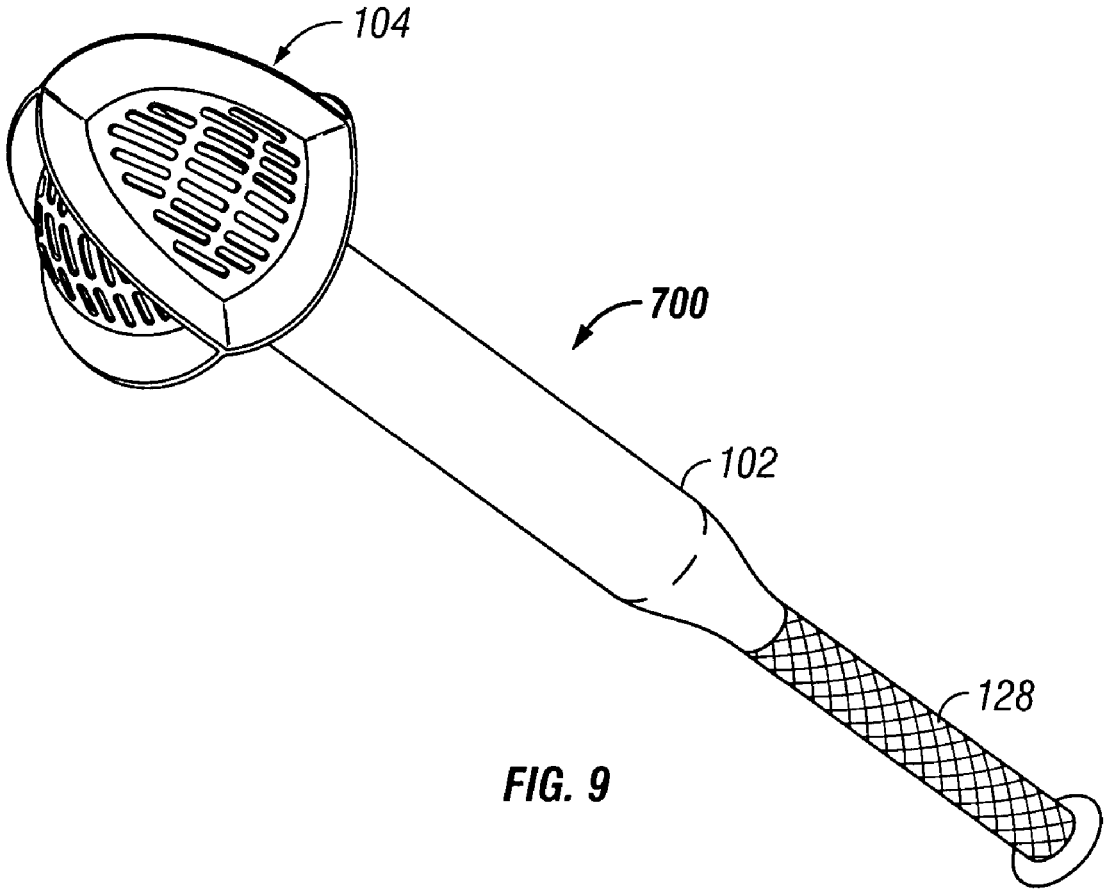
FIG. 9 and FIG. 10 are illustrations of perspective views of examples of simulated handles.
Figure 10:
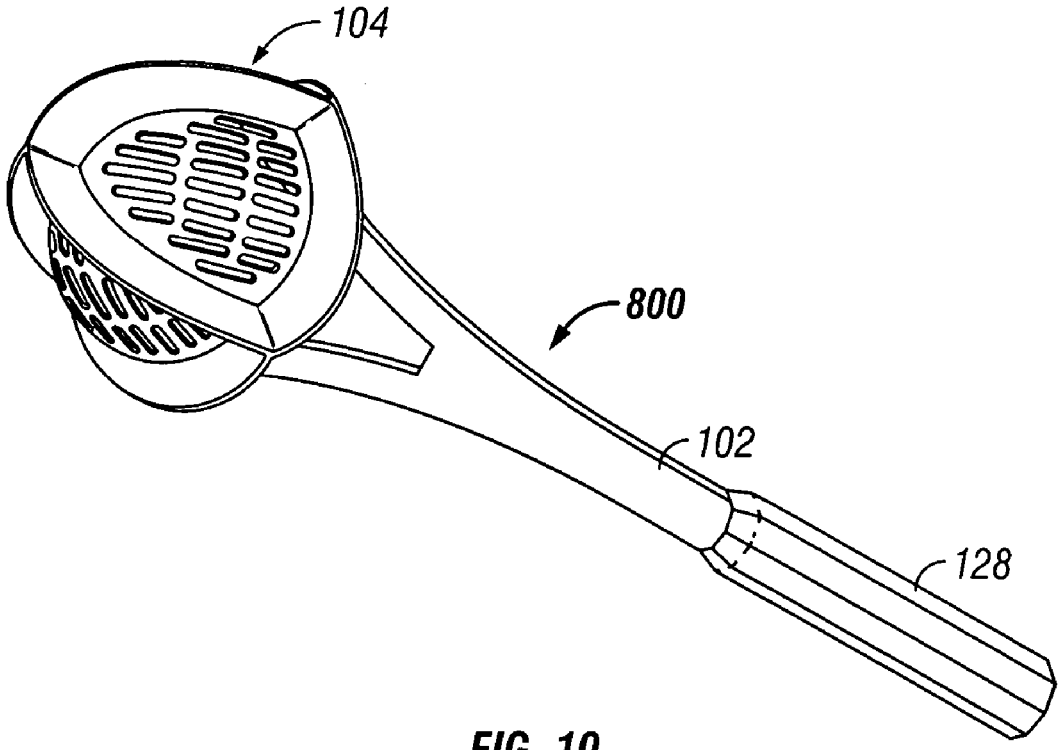

The handle 102 may have any of numerous sizes, shapes, and configurations and may be formed to simulate the "look and feel" of a particular piece of sporting equipment. FIG. 9 and FIG. 10 are illustrations of perspective views of two examples of simulated handles 102. FIG. 9 is an illustration of a perspective view of an aquatic exercise device 700 in accordance with a seventh exemplary embodiment of the invention where the handle 102 is configured to simulate a baseball bat. FIG. 10 is an illustration of a perspective view of an aquatic exercise device 800 in accordance with an eighth exemplary embodiment of the invention where the handle 102 is configured to simulate a tennis racquet.

FIG. 11 through FIG. 14 are illustrations of perspective partial views of do/me-shaped bells 104 including examples of fins 116, 118 suitable for use with the aquatic exercise devices 100, 200, 300, 400, 500, 600, 700, 800. FIG. 11–FIG. 14 are illustrations of partial views taken along the X-axis in the plane of one of the axial fins 116. Although only one axial fin is shown in FIG. 11–FIG. 14, any number of fins 116, 118 may be used. Those skilled in the art will readily recognize the modifications, variations, and other types of the fins 116, 118 that may be applied in an aquatic exercise device based on these teachings and for providing various different calculated resistance. The various features discussed below, for example, may be combined with other features to produce other fin shapes and arrangements.

Figure 11:
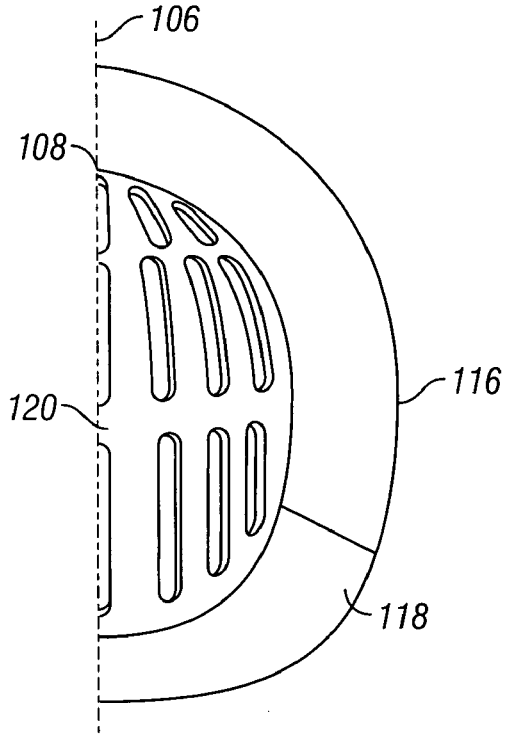
FIG. 11 through FIG. 14 are illustrations of perspective partial views of dome-shaped bells including examples of fins suitable for use with aquatic exercise devices.

FIG. 11 is an illustration of a perspective partial view of a dome-shaped bell 104 including an axial fin 116 and a transverse fin 118 where the axial fins 116 have nearly consistent height. The exemplary axial fin 116 has a nearly uniform height from the surface 120 of the section 112 and may have a height anywhere from one to five centimeters. The height of the exemplary axial fin 116, however, may be less than a centimeter or greater than five centimeters in some situations. The exemplary transverse fin 118 is angled toward the handle 102 and therefore, has a lower height near the center of the section 112 and a greater height bear the edges of the section 112.

Figure 12:
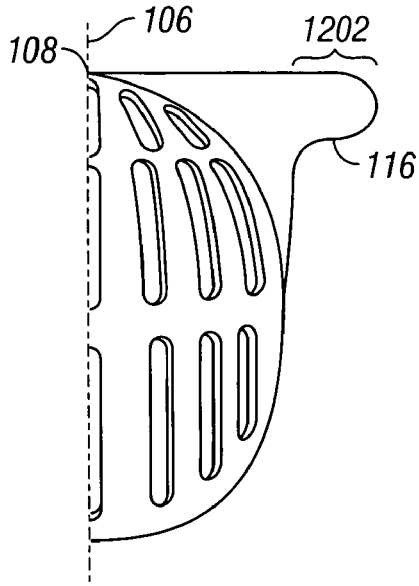

FIG. 12 is an illustration of a perspective partial view of a dome-shaped bell 104 including an axial fin 116 having a lateral extension near the apex 108. The exemplary axial fin 116 extends at a minimal height at the apex 108, extends laterally near apex 106, and tapers into the surface 120 near the top portion of the dome-shaped bell 104. The resulting exemplary axial fin 116 has little height near the bell opening 114 and includes a protrusion 1202.

Figure 13:
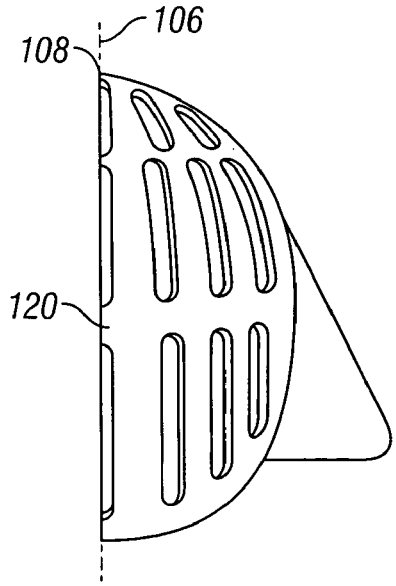

FIG. 13 is an illustration of a perspective partial view of a dome-shaped bell 104 including an axial fin 116 having a lateral extension near the bell opening 114. The exemplary axial fin 116 extends at a maximum height at bell opening 114, extends laterally near the bell opening 114, and tapers into the surface 120 near the bottom portion of the dome-shaped bell 104. The resulting exemplary axial fin 116 has a minimal height near the apex 108.

Figure 14:
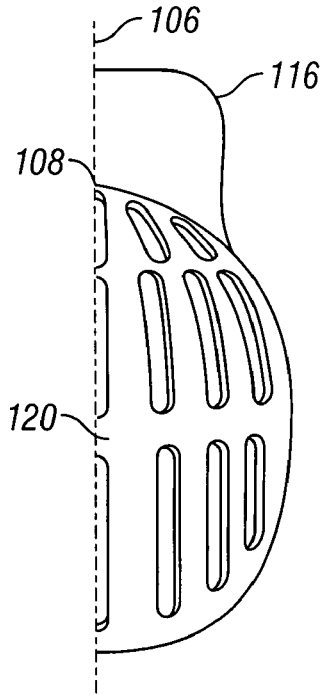

FIG. 14 is an illustration of a perspective partial view of a dome-shaped bell 104 including an axial fin 116 having a lateral extension near the apex 108 and a maximum height near the apex 108. The exemplary axial fin 116 extends at a maximum height at the apex 108, extends laterally near apex 106, and tapers into the surface 120 near the top portion of the dome-shaped bell 104. The resulting exemplary axial fin 116 has little height near the bell opening 114.

Clearly, other embodiments and modifications of this invention will occur readily to those of ordinary skill in the art in view of these teachings. The above description is illustrative and not restrictive. This invention is to be limited only by the following claims, which include all such embodiments and modifications when viewed in conjunction with the above specification and accompanying drawings. The scope of the invention should, therefore, be determined not with reference to the above description, but instead should be determined with reference to the appended claims along with their full scope of equivalents.

We claim:

1. An aquatic exercise device comprising:

a dome-shaped bell having an axis, an opening opposite an apex of the dome-shaped bell and a plurality of apertures extending between an interior and an outer surface of the dome-shaped bell and configured to allow water flow when the device is moved through water; and a handle having a handle axis and connected to the interior of the dome-shaped bell and extending from the apex through the opening, at least a portion of the handle positioned outside of the interior of the dome-shaped bell, the handle comprising two handgrips outside the interior of the dome-shaped bell.

2. An aquatic exercise device in accordance with claim 1, further comprising:

a plurality of fins symmetrically arranged along the outer surface of the dome-shaped bell.

3. An aquatic exercise device in accordance with claim 2, wherein the handle axis is parallel to the bell axis.

4. An aquatic exercise device in accordance with claim 3, wherein the handle axis is coaxial with the bell axis.

5. An aquatic exercise device in accordance with claim 1, wherein a handle angle formed between the handle axis and the bell axis is between zero and ninety degrees.

6. An aquatic exercise device in accordance with claim 1, further comprising another dome-shaped bell connected to the handle opposite the single dome-shaped bell.

7. An aquatic exercise device in accordance with claim 6, wherein the handle axis and the bell axis coincide with another bell axis of the another dome-shaped bell, the another bell axis extending from an apex of the another dome-shaped bell to a bell opening of the another dome-shaped bell.

8. An aquatic exercise device comprising:

a dome-shaped bell having an opening opposite an apex of the dome-shaped bell and a plurality of apertures extending between an interior and an outer surface of the dome-shaped bell and configured to allow water flow when the device is moved through water;

a handle connected to the interior of the dome-shaped bell and extending from the apex through the opening; and a plurality of fins symmetrically arranged along the outer surface of the dome-shaped bell and comprising at least two longitudinal fins extending from the apex to the opening of the dome-shaped bell and a transverse fin extending between the at least two longitudinal fins.

9. An aquatic exercise device comprising:

a first dome-shaped bell having a first bell axis, a first bell apex, a first bell opening and a first outer surface, a first plurality of apertures in the first outer surface, and a first plurality of fins symmetrically arranged along the first outer surface and comprising at least two first longitudinal fins extending from the first bell apex to the first bell opening of the first dome-shaped bell and at least one first transverse fin extending between the first longitudinal fins;

a second dome-shaped bell having a second bell axis, a second bell apex, a second bell opening and a second outer surface, a second plurality of apertures in the second outer surface, and a second plurality of fins symmetrically arranged along the second outer surface and comprising at least two second longitudinal fins extending from the second bell apex to the second bell opening of the second dome-shaped bell and at least one second transverse fin extending between the second longitudinal fins; and a handle having a first end connected to an interior of the first dome-shaped bell through a first bell opening and a second end connected to a second interior of the second dome-shaped bell through a second bell opening, the handle having a that is coaxial with the first bell axis and the second bell axis and a second bell axis, the first bell axis extending through a center of the first bell opening through a first bell apex opposite the first bell opening and the second bell axis extending from a center of the second bell opening to a second bell apex of the second dome-shaped bell.

10. An aquatic exercise device comprising:

a dome-shaped bell having an opening opposite an apex of the dome-shaped bell, and further having a plurality of apertures extending between an interior and an outer surface of the dome-shaped bell and configured to allow water flow when the device is moved through water;

a weight embedded in the apex of the dome-shaped bell; and a handle connected to the interior of the dome-shaped bell and extending from the apex through the opening such that at least a portion of the handle is outside of the dome-shaped bell.

11. An aquatic exercise device in accordance with claim 10, wherein the handle is configured to simulate a baseball bat.

12. An aquatic exercise device in accordance with claim 10, wherein the handle is configured to simulate a tennis racquet.

13. An aquatic exercise device in accordance with claim 10, wherein the handle is configured to simulate a golf club shaft.

14. An aquatic exercise device in accordance with claim 10, further comprising:

a plurality of fins symmetrically arranged along the outer surface of the dome-shaped bell.

* * * * *